US005435126A

United States Patent [19]

Beaudoin

[11] Patent Number: 5,435,126

[45] Date of Patent: Jul. 25, 1995

[54] FUEL NOZZLE FOR A TURBINE HAVING DUAL CAPABILITY FOR DIFFUSION AND PREMIX COMBUSTION AND METHODS OF OPERATION

[75] Inventor: Ronald J. Beaudoin, Schenectady, N.Y.

[73] Assignee: General Electric Company, Schenectady, N.Y.

[21] Appl. No.: 212,401

[22] Filed: Mar. 14, 1994

[51] Int. Cl.[6] ..... F02C 3/20

[52] U.S. Cl. ..... 60/39.463; 60/737; 60/742; 60/748

[58] Field of Search ..... 60/737, 748, 39.463, 60/740, 742, 749

[56] References Cited

U.S. PATENT DOCUMENTS

| | | | |
|---|---|---|---|
| 4,589,260 | 5/1986 | Krockow | 60/737 |
| 4,982,570 | 1/1991 | Waslo et al. | 60/737 |
| 5,218,824 | 6/1993 | Cederwall et al. | 60/748 |
| 5,237,812 | 8/1993 | Mumford | 60/39.463 |
| 5,295,352 | 3/1994 | Beebe et al. | 60/737 |

*Primary Examiner*—Timothy S. Thorpe

*Attorney, Agent, or Firm*—Nixon & Vanderhye

[57] ABSTRACT

The fuel nozzle includes an annular chamber defined between a housing and a central tube. At the downstream end of the tube, inner and outer swirlers are provided in communication with the upstream chamber and a combustion zone downstream of the swirlers. When fuel gas is supplied the inner swirler, a portion of the air flowing through the chamber mixes in the inner swirler with the supplied fuel for holding a diffusion flame in a downstream diffusion mixing cup. The balance of the air flowing through the chamber through the outer swirler is segregated from the air supplied the inner swirler by a circumferentially extending splitter vane. At an upstream portion of the chamber a plurality of spokes pass into the chamber for supplying fuel gas to the chamber when the nozzle operates in a premix combustion mode. When operating in a premix combustion mode, fuel gas is cut off from the inner swirler and supplied to the spokes. The fuel and air are mixed in the chamber and pass through both the inner and outer swirlers, forming a premix flame front within a downstream premix cup in the combustion zone.

15 Claims, 2 Drawing Sheets

FUEL NOZZLE FOR A TURBINE HAVING DUAL CAPABILITY FOR DIFFUSION AND PREMIX COMBUSTION AND METHODS OF OPERATION

TECHNICAL FIELD

The present invention relates to a fuel nozzle for a turbine which combines in a single nozzle a dual capability for diffusion and premix combustion and particularly relates to a nozzle for a combustor where the air supply is split using only a portion of the air supply for diffusion combustion and the totality of the air supplied for premix combustion.

BACKGROUND

As well known, the primary air polluting emissions usually produced by gas turbines burning conventional hydrocarbon fuels are oxides of nitrogen, carbon monoxide and unburned hydrocarbons. Also well known is the fact that oxidation of molecular nitrogen in air-breathing engines is highly dependent upon the maximum hot gas temperature in the combustion system reaction zone. As temperature rises, for example, in the combustor, the rate of chemical reactions forming oxides of nitrogen increase exponentially. However, if the temperature of the combustion chamber hot gas is controlled to a lower level, thermal $NO_x$ will be produced at very low rates.

One method of controlling the temperature of the reaction zone of a combustor at levels at which minimal thermal $NO_x$ is formed is to premix fuel and air to a lean mixture prior to combustion. The thermal mass of the excess air present in the reaction zone of a lean premix combustor absorbs heat and reduces the temperature rise of the products of combustion to a level where minimal $NO_x$ is formed. One problem associated with premix combustion is that the fuel/air mixture strength must be reduced to a level close to the lean flammability limit for most hydrocarbon fuels. As a consequence, lean premixed combustors tend to be less stable than more conventional diffusion flame combustors and do not provide adequate turndown for operation over the entire load range of the turbine. It is highly desirable to obtain the best possible emissions performance over the entire gas turbine operating range from ignition through mid-load while burning a diffusion flame, and mid-load to full load while burning a premix flame.

Burners with diffusion and premix capability for heavy duty industrial gas turbines are known. For example, in prior combustors of that type, all of the air brought into the premix chamber is used for both diffusion and premix combustion modes. Thus, while the air supply may be optimal for premixed combustion mode, the injection of fuel for the diffusion combustion mode into the same total air supplied the premix chamber, simply made the diffusion flame performance non-optimal, e.g., lack of stability of the flame. Other prior combustors employ two separate passages for supplying air in premix and diffusion combustion modes. Where swirlers have been used, to applicant's knowledge, they have not been swirlers having aerodynamic vanes but, rather, flat vanes which cannot be used for flowing air through the air passage for diffusion and premix combustion modes. Thus, two very separate and distinct passages were previously used for premix and diffusion combustion modes and, accordingly, a richer fuel/air ratio in a premix mode and higher $NO_x$ resulted. Further, older combustors employed two distinct air inlets at axially spaced positions along the combustor to achieve diffusion and premix combustion modes.

DISCLOSURE OF THE INVENTION

In accordance with the present invention, there is provided a liquid and gas fuel nozzle for diffusion mode combustion combined within a fuel injector which premixes fuel and air for low emissions combustion in the premix mode. Thus, there is provided a fuel injector for diffusion combustion mode including an inner swirler shrouded by a vane which controls the fuel/air ratio and provides a protected region just downstream of the diffusion gas injection ports yet, because of the aerodynamic design of the swirler and the presence of the splitter vane, renders the flow passage suitable as part of the premix flame holder. An outer swirler surrounds the inner swirler and both are in communication with an upstream chamber to which air from a source, e.g., turbine compressor discharge, air is supplied. The splitter vane thus reduces the air supplied to the inner diffusion swirler to only a portion of the total air supplied the chamber and passing through the inner and outer swirlers. Thus, when fuel is injected into the air passing through the inner swirler, the gas/air mixture in the inner swirler establishes a stabilized diffusion flame in a diffusion mixing cup downstream of the swirlers. By having a dedicated diffusion passage, that is, the inner swirler, and which passage is not suitable as a premix burner per se, the amount of the total air available for premixing in the inner swirler is limited and, consequently, optimum achievable emissions levels of $NO_x$, CO and UHC's are obtained from the combustor in the diffusion combustion mode.

As the turbine is loaded, a stable premix flame can be supported. At that time, the gas fuel supply is switched from supplying gas directly to the flow of air passing through the inner swirler to an upstream portion of the chamber. Consequently, air and fuel is premixed in the chamber and that fuel/air mixture is supplied through both the inner and outer swirlers for stabilization downstream in a premix cup in a recirculation zone.

Consequently, in the premix combustion mode, the totality of the air supplied the chamber is mixed with the fuel and that fuel/air mixture flows through both the inner and outer swirlers. In the diffusion combustion mode, only a portion of the total air flow through the chamber, i.e., the portion flowing through the inner swirler, is mixed with fuel and provides the fuel/air ratio suitable for stabilizing a diffusion flame. The balance of the air passing through the chamber, i.e., through the outer swirler, is prevented from having effect on the diffusion flame by the splitter vane.

In a preferred embodiment according to the present invention, there is provided a nozzle for diffusion and premix modes of combustion in a combustor for a turbine, comprising a nozzle body having an axis and defining a chamber about the axis, the chamber having an upstream portion for receiving air from an upstream air source and a downstream portion, including radially spaced, annular inner and outer swirlers about the axis, each swirler having a plurality of shaped aerodynamic vanes for imparting a swirl to air flowing through the chamber and passing through the aerodynamic vanes. A generally annular vane is disposed between the inner and outer swirlers for separating the flow through the swirlers, with a first fuel supply conduit for supplying fuel for mixing substantially solely with the air flowing through the inner swirler, thereby providing a fuel/air mixture for diffusion combustion and a second fuel supply conduit supplies fuel to the chamber upstream of the swirlers for mixing with air in the chamber to form a fuel/air mixture in the chamber for flow thereof through the inner and outer swirlers for premixed combustion.

In a further preferred embodiment according to the present invention, there is provided a method of operating a combustor for a turbine wherein the combustor includes a nozzle body having an axis, a chamber about the axis and inner and outer swirlers adjacent a downstream portion of the chamber, the steps of supplying air to the chamber for flow downstream through the swirlers, separating the air flow through the swirlers into first and second discrete flows through the inner and outer swirlers, respectively, supplying fuel for mixing substantially solely with the first air flow through the inner swirler to provide a fuel/air mixture for stabilizing diffusion combustion downstream of the swirlers using only a portion of the air supplied to the chamber and supplying fuel to the chamber for mixing with the air flow therethrough to form a fuel/air mixture for operation in a premix combustion mode using a totality of the air supplied to the chamber.

Accordingly, it is a primary object of the present invention to combine the operating characteristics of a diffusion flame combustor with the low emissions capability of a lean premixed combustor and thereby provide a combustion system having dual premix and diffusion combustion capability and therefore functional over the entire operating range of the turbine, yet providing extremely low emissions of air pollutants in the gas turbine exhaust over its operating range. By judicious use of the available air for mixing with the fuel, the emissions capability of the combustor over the entire operating range is thus optimized.

BEST MODE FOR CARRYING OUT THE INVENTION

Figure 1:
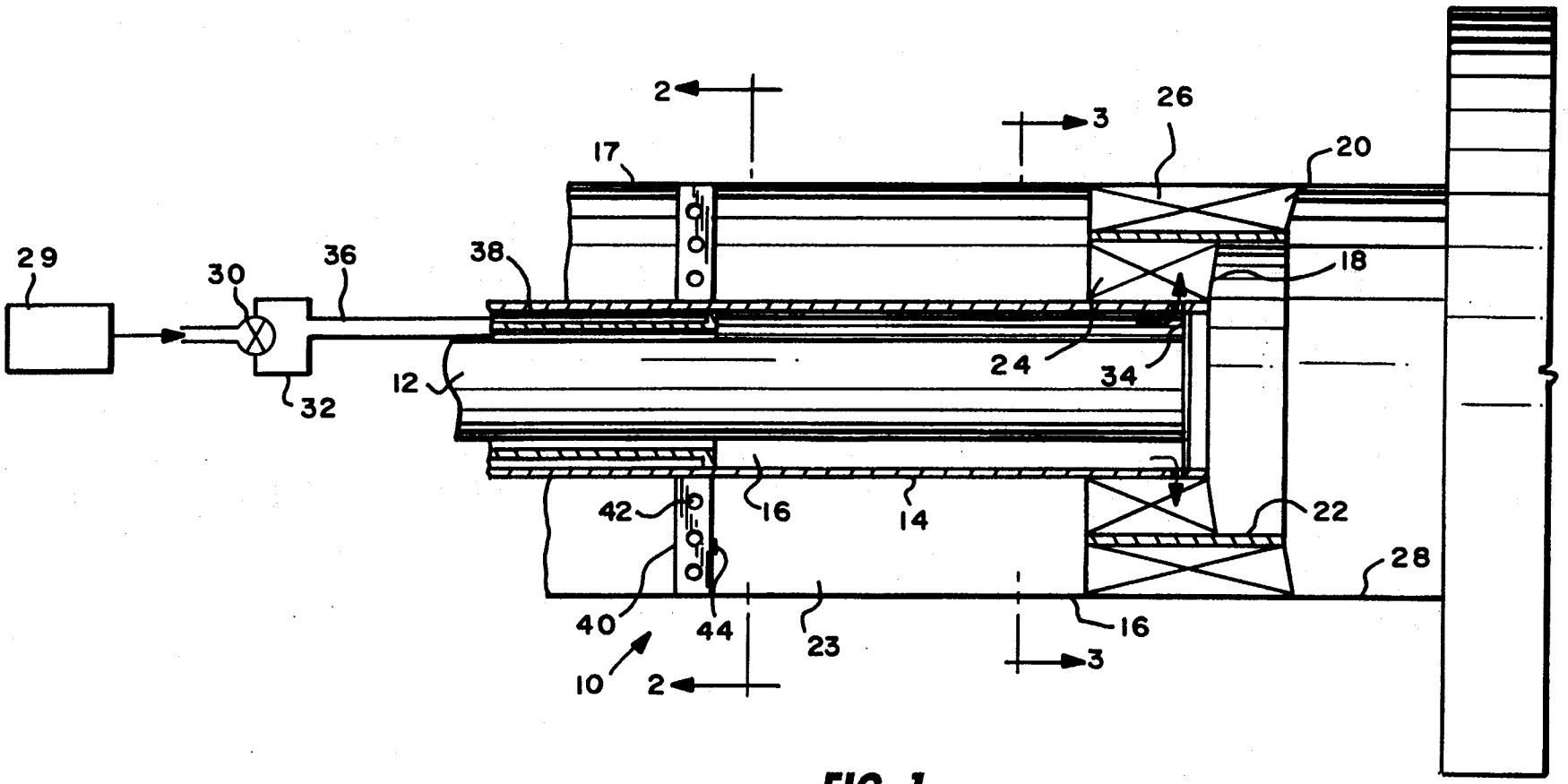
FIG. 1 is a schematic illustration of a dual capability combustor for diffusion and premix combustion modes according to the present invention.
Figure 3:
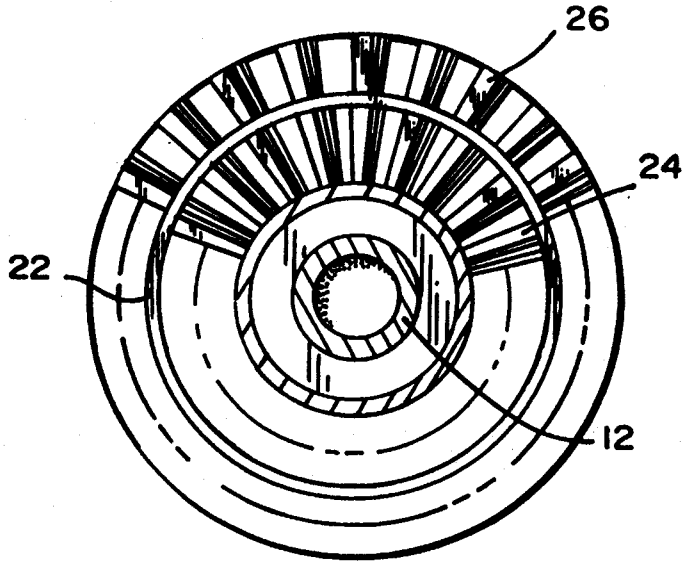
FIGS. 2 and 3 are cross-sectional views thereof taken generally about on lines 2—2 and 3—3 in FIG. 1.
Figure 2:
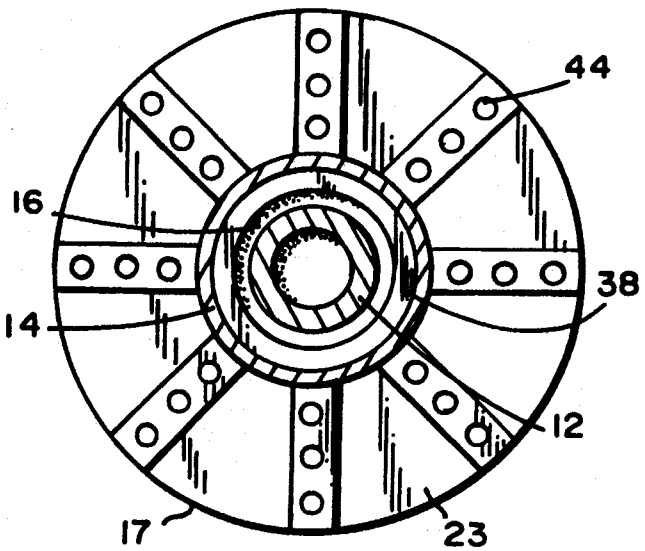

Referring now to FIG. 1, there is provided a combustor, generally designated 10, comprised of a nozzle body including an inner tube 12 serving as a high pressure liquid fuel nozzle spaced inwardly from and surrounded by a central tube 14 defining an annular chamber 16 between tubes 12 and 14. The nozzle body includes an outer housing 17 and inner and outer swirlers 18 and 20, respectively, between the tube 14 and housing 17 adjacent the tip of tube 14. For reasons discussed hereafter, the inner and outer swirlers are separated by a circumferentially extending continuous cylindrical splitter vane 22. Upstream of the swirler vanes 18 and 20 and between the tube 14 and housing 17, there is an annular chamber 23 which, at its upstream end, is supplied with air from a suitable source, such as a compressor discharge. Thus, the air flowing through chamber 23 is split by the vane 22 for flow in part through the inner swirler 18 and in the remaining part, through the outer swirler 20. Note that the outer swirler is axially elongated toward the downstream portion of the nozzle with the splitter vane being coextensive in axial length with the outer swirler 20.

In accordance with the present invention, the inner and outer swirlers are comprised of a plurality of generally radially extending, shaped, aerodynamic vanes 24 and 26, respectively, circumferentially spaced one from the other. That is, the swirler vanes are not flat as in conventional swirlers but, rather, are shaped such that the air flow or fuel/air mixture, as apparent from this description, does not separate from the vanes as rotation is imparted to the air or fuel/air mixture flowing through the vanes. That is, there are no regions of flow separation from the vanes at axial locations along the vanes. Consequently, recirculation zones are inhibited from forming along the axial length of the aerodynamic vanes and any vortex separation or breakdown occurs downstream of the swirler vanes. The interior surface of the cylindrical vane 22, together with the trailing edges of the inner swirler vanes 24, define a diffusion mixing cup. Also, downstream of the outer swirler vanes 20 and vane 22, the housing 17 defines a premix cup 28.

Between the tubes 12 and 14, there is provided a high pressure gas fuel diffusion manifold formed by the annular chamber 16 which is supplied with gas from a source 29 for flow through a valve 30 and a gas supply line 32. Apertures 34 are formed adjacent the tip of tube 12 for flowing the gaseous fuel into the air flowing between the vanes 24 of the inner swirler 18. Additionally, gas fuel may be supplied from supply 29 by way of valve 30 and supply line 36 through a premix manifold 38 for flow into a plurality of circumferentially spaced spokes 40. Spokes 40 are located at the upstream portion of the chamber 23 and in the path of the incoming compressor discharge air. Radial or axial apertures or both radial and axial apertures 42 and 44, respectively, are provided each of the spokes 40 for supplying fuel from the manifold 38 into the chamber 23 where the fuel and air are mixed. It will be appreciated that the valve 30 supplies gaseous fuel to one or the other of the supply lines 32 and 36, or both simultaneously. Accordingly, fuel can be supplied to the nozzle either through the apertures 34 into the inner swirler for mixing with air in a diffusion combustion mode, or through the apertures in the spokes 40 for mixing with the air in chamber 23 in a premix combustion mode, or the fuel can be supplied to both apertures 34 and the apertures in spokes 40 simultaneously.

In using the nozzle, the valve 30 is turned at start-up to supply fuel gas through supply line 32, manifold 16 and apertures 34 into the air flowing through the inner swirler 18. It will be appreciated that the air is supplied from the air source by way of chamber 23 and, hence, only a portion of the air in chamber 23 is supplied the inner swirler 18 for mixing with the fuel gas supplied via apertures 34. This combined diffusion fuel/air mixture exits the diffusion swirler 18 and enters a diffusion mixing cup 22. The swirling flow induces a recirculation zone along the centerline of the diffusion flame mixing cup 22 which causes hot gas to be drawn back from the combustor reaction zone and anchors the flame front within the diffusion flame mixing cup 22. The portion of the air flowing through the outer swirler 20 is separated from the fuel/air mixture exiting the inner swirler 18 by the splitter vane 22. Thus, reduced air, i.e., a fraction of the total air supplied chamber 24, is supplied to the inner swirler 18. This is optimum for the diffusion combustion mode and the flame produces optimum achievable $NO_x$, CO and UHC emissions levels in that mode.

In a premix combustion mode, the valve 30 is turned to cut off the supply of gas fuel via line 32 and to supply gas fuel via line 36 to the spokes 40 and through the apertures into the air in the chamber 23. Thus, the fuel is distributed by the spokes 40 for mixing with the entirety of the air supplied chamber 23. The fuel/air mixture in the premix combustion mode enters both inner and outer swirlers 18 and 20. The aerodynamic vanes within the inner and outer swirlers accelerate the flow to a high velocity swirl which prevents flashback of combustion from the reaction zone into chamber 23 now serving as the premix chamber. The rotation of the premixed flow exiting the swirlers causes a central recirculation flow of hot gases from the combustion chamber into the premix cup 28, hence stabilizing the premix flame front within the premix cup. Consequently, it will be appreciated that the entirety of the air flowing into the chamber 23 from the compressor discharge is used for mixing with the fuel exiting the spokes. Thus, a lean fuel/air ratio in the premix mode is obtained, hence reducing the level of $NO_x$ emissions at mid to high load operating range of the turbine.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A nozzle for diffusion and premix modes of combustion in a combustor for a turbine, comprising:

a nozzle body having an axis and defining a chamber about said axis, said chamber having an upstream portion for receiving air from an upstream air source and a downstream portion, including radially spaced, annular inner and outer swirlers about said axis, each swirler having a plurality of shaped aerodynamic vanes for imparting a swirl to air flowing through said chamber and passing through said aerodynamic vanes;

a generally annular vane disposed between said inner and outer swirlers for separating the flow through said swirlers;

a first fuel supply conduit for supplying fuel for mixing substantially solely with the air flowing through said inner swirler, thereby providing a fuel/air mixture for diffusion combustion; and a second fuel supply conduit for supplying fuel to said chamber upstream of said swirlers for mixing with air in said chamber to form a fuel/air mixture in said chamber for flow thereof through said inner and outer swirlers for premixed combustion.

2. A nozzle according to claim 1 wherein said second fuel supply conduit includes a plurality of generally radially extending circumferentially spaced spokes in said chamber, each spoke having at least one aperture for supplying fuel into said chamber.

3. A nozzle according to claim 1 wherein said nozzle body includes a central tube, said inner swirlers being carried by said central tube adjacent an end thereof and extending radially outwardly thereof, said central tube including apertures forming part of said first fuel supply conduit for supplying fuel to said inner swirlers.

4. A nozzle according to claim 1 wherein downstream edges of said inner swirler vanes terminate short of downstream edges of said outer swirler vanes, said annular vane extending downstream of said inner swirler vanes and terminating substantially coextensively with the downstream edges of said outer swirler vanes.

5. A nozzle according to claim 1 including means for supplying fuel to said first and second fuel supply conduits for alternately supplying fuel to said inner swirler and said chamber.

6. A nozzle according to claim 1 including a diffusion flame cup downstream of said inner swirler.

7. A nozzle according to claim 1 including a premix flame cup downstream of said outer swirler.

8. A nozzle according to claim 1 wherein said second fuel supply conduit includes a plurality of generally radially extending circumferentially spaced spokes in said chamber, each spoke having at least one aperture for supplying fuel into said chamber, said nozzle body including a central tube, said inner swirlers being carried by said central tube adjacent an end thereof and extending radially outwardly thereof, said central tube including apertures forming part of said first fuel supply conduit for supplying fuel to said inner swirlers.

9. A nozzle according to claim 8 wherein downstream edges of said inner swirler vanes terminate short of downstream edges of said outer swirler vanes, said annular vane extending downstream of said inner swirler vanes and terminating substantially coextensively with the downstream edges of said outer swirler vanes.

10. A nozzle according to claim 9 including means for supplying fuel to said first and second fuel supply conduits for alternately supplying fuel to said inner swirler and said chamber, a diffusion flame cup downstream of said inner swirler and a premix flame cup downstream of said outer swirler.

11. In a method of operating a combustor for a turbine wherein the combustor includes a nozzle body having an axis, a chamber about said axis and inner and outer swirlers adjacent a downstream portion of the chamber, the steps of:

supplying air to the chamber for flow downstream through the swirlers;

separating the air flow through the swirlers into first and second discrete flows through said inner and outer swirlers, respectively;

supplying fuel for mixing substantially solely with the first air flow through the inner swirler to provide a fuel/air mixture for stabilizing diffusion combustion downstream of said inner swirler using only a portion of the air supplied to the chamber;

supplying fuel to said chamber for mixing with the air flow therethrough to form a fuel/air mixture therein for operation of the combustor in a premix combustion mode using a totality of the air supplied to the chamber and;

flowing the fuel/air mixture from said chamber for operation of the combustor in the premix combustion mode through both said inner swirler and said outer swirler.

12. A method according to claim 11 including alternating the supply of fuel to the inner swirler and the chamber to alternate between diffusion and premix combustion modes.

13. A method according to claim 11 wherein the step of supplying fuel for mixing solely with the first air flow includes supplying fuel directly into the inner swirler.

14. A method according to claim 11 wherein the step of supplying fuel to the chamber includes first directing fuel in a radially outwardly direction for mixing with the air flowing axially in said chamber.

15. A method according to claim 11 including alternating the supply of fuel to the inner swirler and the chamber to alternate between diffusion and premix combustion modes, the step of supplying fuel for mixing solely with the first air flow including supplying fuel directly into the inner swirler and the step of supplying fuel to the chamber includes first directing fuel in a radially outwardly direction for mixing with the air flowing axially in said chamber.

* * * * *